US006467649B1

(12) United States Patent
Ullman et al.

(10) Patent No.: US 6,467,649 B1
(45) Date of Patent: Oct. 22, 2002

(54) SINGLE VEND NEWSPAPER DISPENSING MACHINE

(75) Inventors: Ralph H. Ullman; Frank Paulas, both of Shiner, TX (US)

(73) Assignee: Kaspar Wire Works, Inc., Shiner, TX (US)

( * ) Notice: Subject to any disclaimer, the term of this patent is extended or adjusted under 35 U.S.C. 154(b) by 27 days.

(21) Appl. No.: 09/698,312

(22) Filed: Oct. 27, 2000

(51) Int. Cl.[7] ..... B65H 3/00
(52) U.S. Cl. ..... 221/192; 221/195
(58) Field of Search ..... 221/191, 192, 221/194, 195, 213, 210, 268, 272, 259, 9, 15

(56) References Cited

U.S. PATENT DOCUMENTS 3,428,215 A * 2/1969 Wells ..... 221/191
6,003,725 A * 12/1999 Blankenau et al. ..... 221/195

* cited by examiner

*Primary Examiner*—Kenneth W. Noland
(74) *Attorney, Agent, or Firm*—Jackson Walker LLP

(57) ABSTRACT

A newspaper vending machines for vending a single copy of a periodical. The newspaper vending machine includes a generally rectangular cabinet with a separate periodical loading door and periodical dispensing opening having a door. A coin controlled latching mechanism controls the operation of the door of the dispensing opening. The periodicals rest on a moveable platform, which can move upward as the periodicals are dispense through the dispensing opening. A carriage assembly, the carriage assembly in operative engagement with the dispensing handle, includes a multiplicity of fingers depending vertically downward from a rearward member on the carriage assembly. The fingers engage the trailing edge of the top periodical and, when the dispensing door is opened, the carriage assembly moves the top periodical to the dispensing opening for receipt by a consumer.

13 Claims, 13 Drawing Sheets

SINGLE VEND NEWSPAPER DISPENSING MACHINE

BACKGROUND OF THE INVENTION

1. Field of The Invention

Applicant's invention relates to single copy vending machines for newspapers and the like. More particularly, Applicant's invention relates to a single vend machine for newspapers which uses a carriage, movable across a stack of newspapers to dispense the topmost newspaper.

2. Background Information

Newspaper vending machines are a popular way of distributing newspapers throughout the country. Most newspaper vending machines act on an "honor" system. The consumer inserts the required amount of coinage into the mechanism of the vending machine which then allows the consumer access to a newspaper cabinet where a stack of newspapers is located. A dishonest consumer may take more than one edition of the newspaper, which happens, on occasion.

Thus what is needed in the industry is a simple device that will deter theft and dispense only a single newspaper to the consumer.

A number of inventors have approached the problems of providing a single copy vending machine for newspapers and the like. Some of these may be found in the following: U.S. Pat. No. 4,865,178 to Lewandowski; U.S. Pat. No. 4,377,228 to Ostermann; 4,375,844 to Facto; U.S. Pat. No4,393,970 to Stack, Jr.; U.S. Pat. No. 5,143,251 to Kahanek; U.S. Pat. No. 4,258,861 to Traill; U.S. Pat. No. 4,174,047 to Owens; U.S. Pat. No. 4,654,513 to Hennessy; U.S. Pat. No. 4,530,444 to Christian; U.S. Pat. No. 4,465,207 to Chalabian; U.S. Pat. No. 4,140,242 to Muller; U.S. Pat. No. 4,067,477 to Chalabian; U.S. Pat. No. 3,912,124 to Pinkerton; U.S. Pat. No. 4,700,869 to Bogner; and, U.S. Pat. No. 4,558,803 to Draper.

Applicant's experience with prior art single vend newspaper dispensing machines has revealed a number of shortcomings. For example, mechanical elements which physically move a paper from a stored position to a dispensed position, have been troubled by a balky motion, that tends to cause a "hangup." Further, in most prior art machines with elevators to move a stack of newspapers up as the newspapers are being dispensed from the stack, the elevator motion has been balky rather than smooth, sensitive and free. Those prior art machines that use fingers to engage a newspaper from a newspaper stack, have not provided means to readily adjust the fingers for either the different thicknesses of individual newspapers or to account for the fact that sometimes the stack newspapers will "bow" and cause the finger engagement to pickup more than one newspaper. Further, prior art limitations include the machine's inability to display and dispense the displayed copy before sell out.

Prior art vending machines have been too mechanically complex and expensive to produce. They have been difficult to adjust and load and jam too easily. They occasionally dispense more than one paper or fail to dispense at all.

Some prior art newspaper vending machines use a variable gate opening which includes a separation device for separating the topmost newspaper from the stack and then a gate or a gauging device that will allow access by the customer to the topmost paper of the stack. For example, U.S. Pat. No. 4,654,513 shows a telescoping rod allowing gravity to dispense the topmost paper in the angled stack of papers. The telescoping rod may be dropped to allow the topmost paper to fall towards the dispensing door. An electrical switch, which the topmost newspaper passes over, instructs the telescoping rod to "stop" thus allowing only a single copy to vend.

Applicant has a found in the novel invention described and claimed herein, solutions to the above styled shortcomings (and to other shortcomings) in providing a carriage assembly for dispensing a single newspaper from a stack of newspapers, the stack of newspapers urged upward on a spring loaded elevator.

Applicant's bearing mounted carriage assembly includes floating, adjustable fingers on a hinged platform. The fingers are manually set and may be independently adjusted for the twist or bowing of the stack.

Applicant has also provided for a display copy of the newspaper which may be dispensed following the dispensing of the last newspaper from the stack of newspapers located on the elevated platform.

Applicant has also provided for a single vend newspaper vending machine which has a spring loaded storage platform which rides on ball bearings and is sensitive due partly to the use of counteracting springs.

Applicant further provides a single vend newspaper vending machine which may be operated by a mechanical, coin-controlled door unlatch mechanism or an electrical door unlatch mechanism which includes a latch that engages means to prevent illegal "pumping" of the carriage assembly in an attempt to effect multiple dispensing of newspaper.

Applicant's novel device contains fewer moving parts, is cheaper to manufacture and is more efficient than prior single vend newspaper vending machines.

Applicant's single vend device also includes a separate newspaper dispensing door located below the paper loading door.

Applicant's single vend dispensing machine has a spring loaded elevator for maintaining the stack of periodicals, which elevator is mounted to dual guide bars to help stabilize the elevator and on ball bearings to help the elevated platform move up and down smoothly.

Likewise, Applicant's carriage assembly is mounted to dual guide bars with roller or ball bearings to make for smoother dispensing of the newspaper or periodical.

DETAILED DESCRIPTION OF THE PREFERRED EMBODIMENT

FIGS. 1, 2, 3, and 9 illustrate various views of Applicant's single vend newspaper dispensing machine. As can be seen as referenced to the figures from the exterior, the single vend newspaper dispensing machine (10) is seen to include a cabinet (12), typically rectangular. The cabinet includes walls including a top wall (14) and a front wall (16), and contains elements and parts designed to accept money and dispense only a single newspaper to the consumer. This is in contrast to typical newspaper coin operated vending machines in which access to these machines is provided with a coin operated mechanism, where upon opening the door to such a typical coin operated newspaper vending machine, the dishonest consumer may take more than one newspaper from a stack therein. Applicant's single vend newspaper dispensing machine (10) provides, however, for dispensing to the consumer only a single newspaper.

Figure 2:
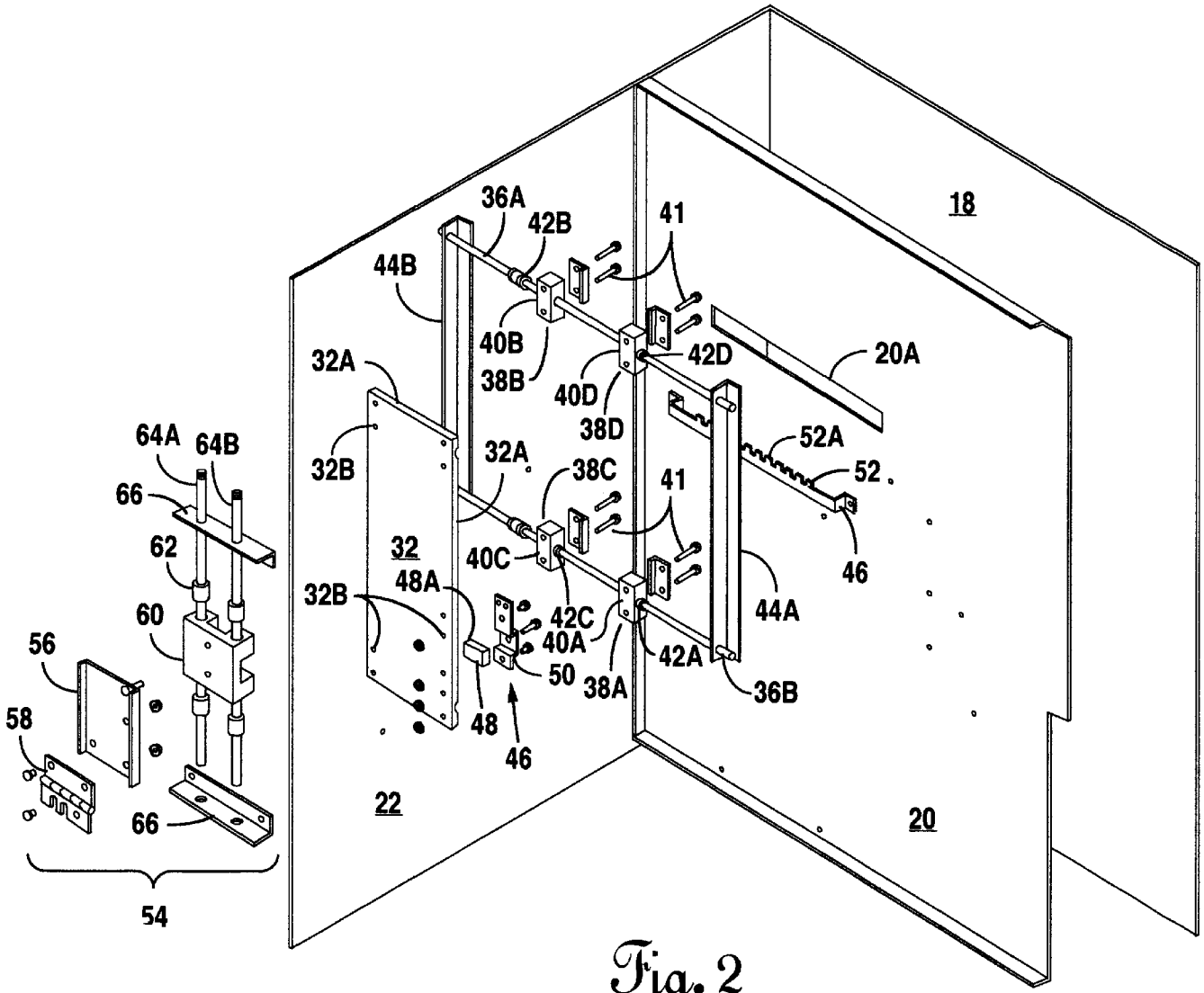
FIG. 2 is an exploded perspective view of part of the carriage assembly and other components of Applicant's invention.

Turning back to the cabinet, it is seen that front wall (16) has a dispenser opening (16A) therein, as well as a paper loading opening (16B). In the dispenser opening (16A) the dimension is such that access is provided from outside the dispensing machine to the interior thereof for the consumer to reach a hand through and obtain a single issue of the desired periodical dispensed according to the specifications and by the method set forth in more detail below. The loading opening (16B) provides a means for a route man to load a stack of newspapers into the cabinet, the newspapers to be dispensed one by one, in manner set forth in more detail below. Further, it is seen that the dispenser opening (16A) is typically located below the paper loading opening (16B), with the latter being substantially larger since the route man will typically insert into the interior of the cabinet a stack of periodicals or newspapers whereas the consumer will be extracting only a single copy through paper dispenser opening (16A). FIG. 2 illustrates additional walls of cabinet (12), here right side wall (18) inner partition (20) with slot (20A) and rear wall (22).

Figure 6:
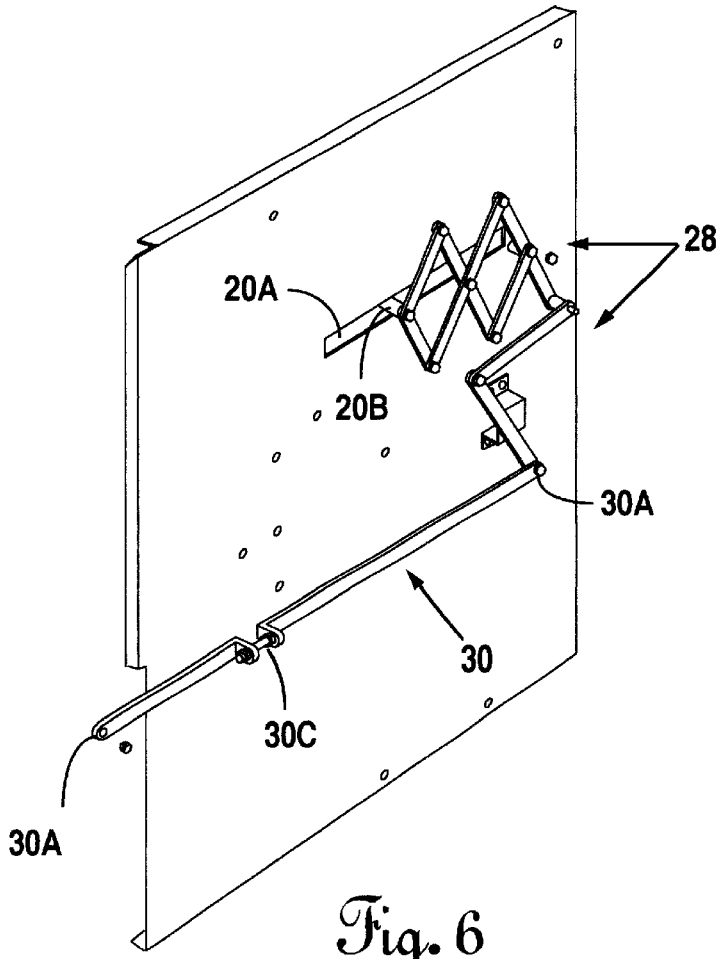
FIGS. 6 and 6A are perspective views of details of the scissors assembly and scissors assembly adjustable arm of Applicant's invention.
Figure 6A:
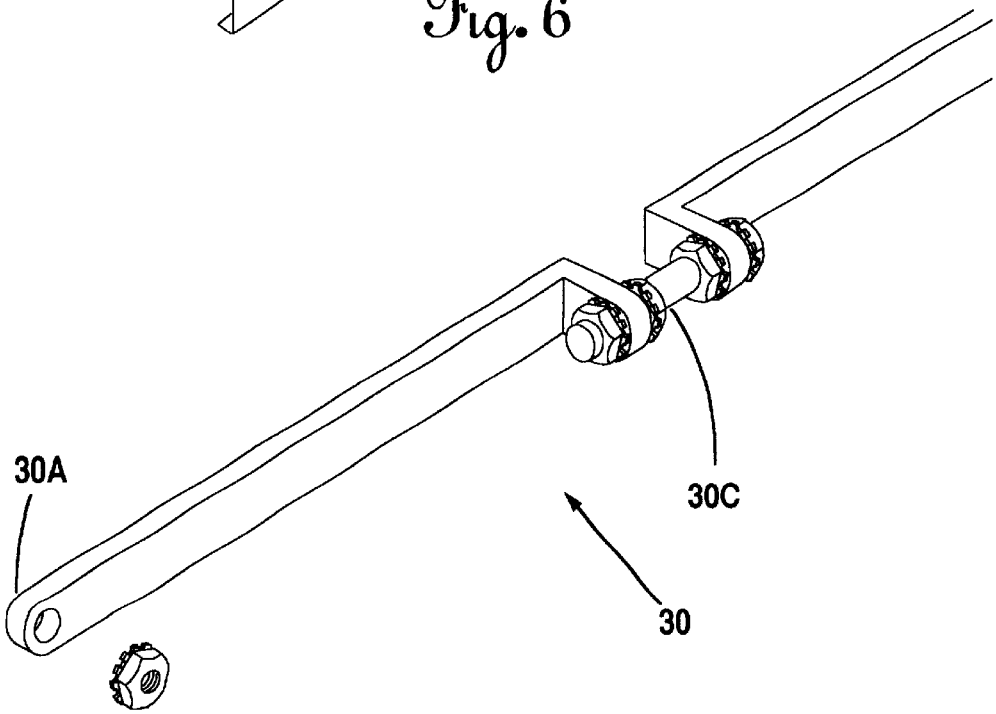

Applicant's single vend newspaper dispensing machine (10) includes a coin controlled latching mechanism (23) having an outer face or wall (23A) with a coin slot opening (23B) therein. The coin control latching mechanism may be anyone of a number of those well known in the art, for example assignee's mechanical and electronic coin mechanism. When a coin or coins of the proper denomination are fed through coin slot (23B), a latching handle (24) with a latch (26) thereon may be moved from a closed and latched position (flush to wall (23A) to an open position pivoted (away from wall (23A)) by action of the coin control mechanism on latch (26). As can be seen from FIG. 1, the handle is accessible to the consumer outside the cabinet and has a scissors assembly adjustable operating arm (30) attached thereto. More specifically, scissors assembly adjustable arm (30) has a first end (30A) attached to the handle and a removed end (30B),attached to a scissors assembly (28). The scissors assembly adjustable operating arm includes a central portion (30C) that allows the end of the arm to be adjusted and set to a predetermined length as set forth in more detail with reference to FIG. 6A below.

Figure 7:
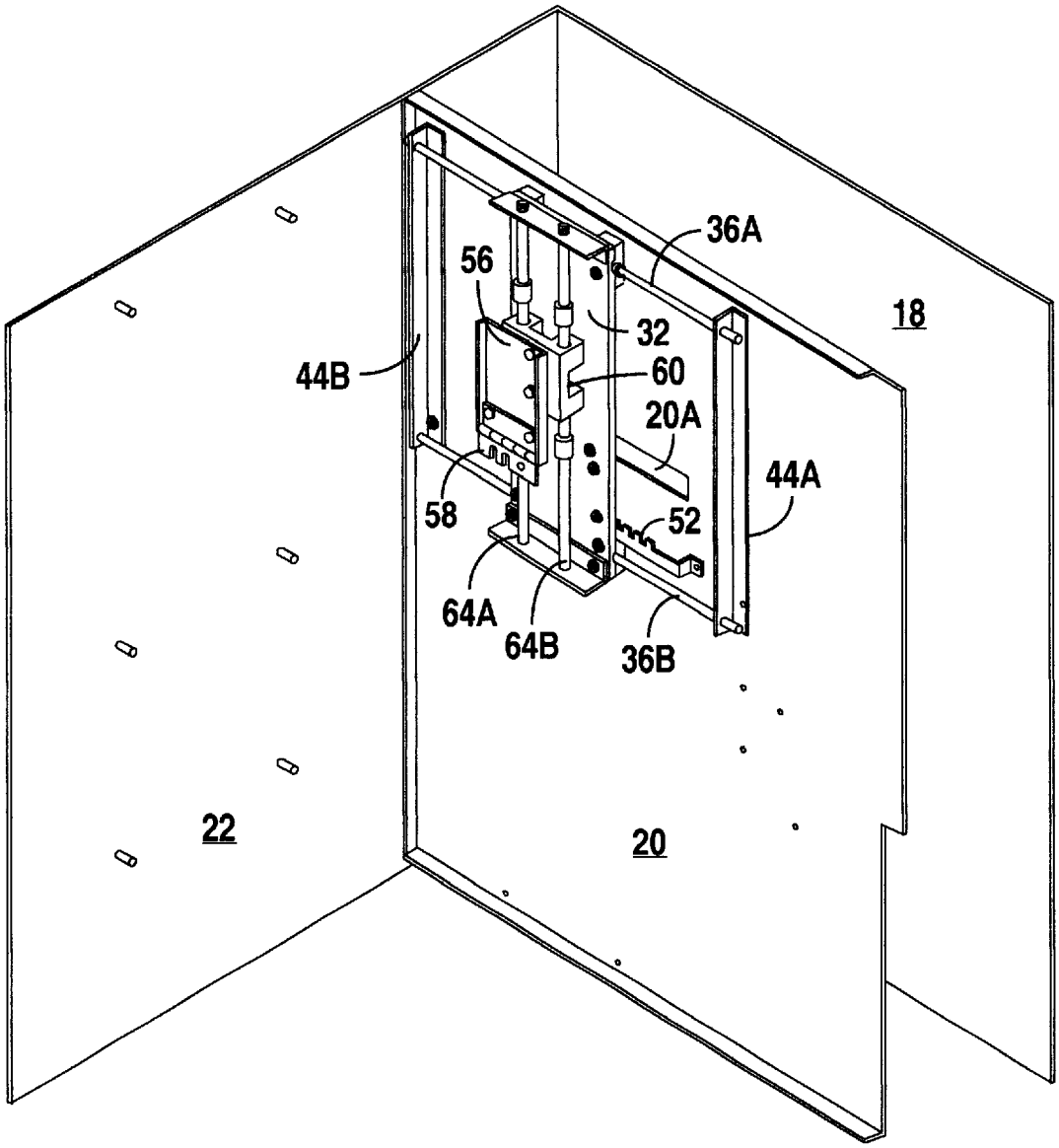
FIGS. 7 and 7A are perspective views of details of Applicant's drive plate guide assembly and elevator assembly respectively.
Figure 7A:
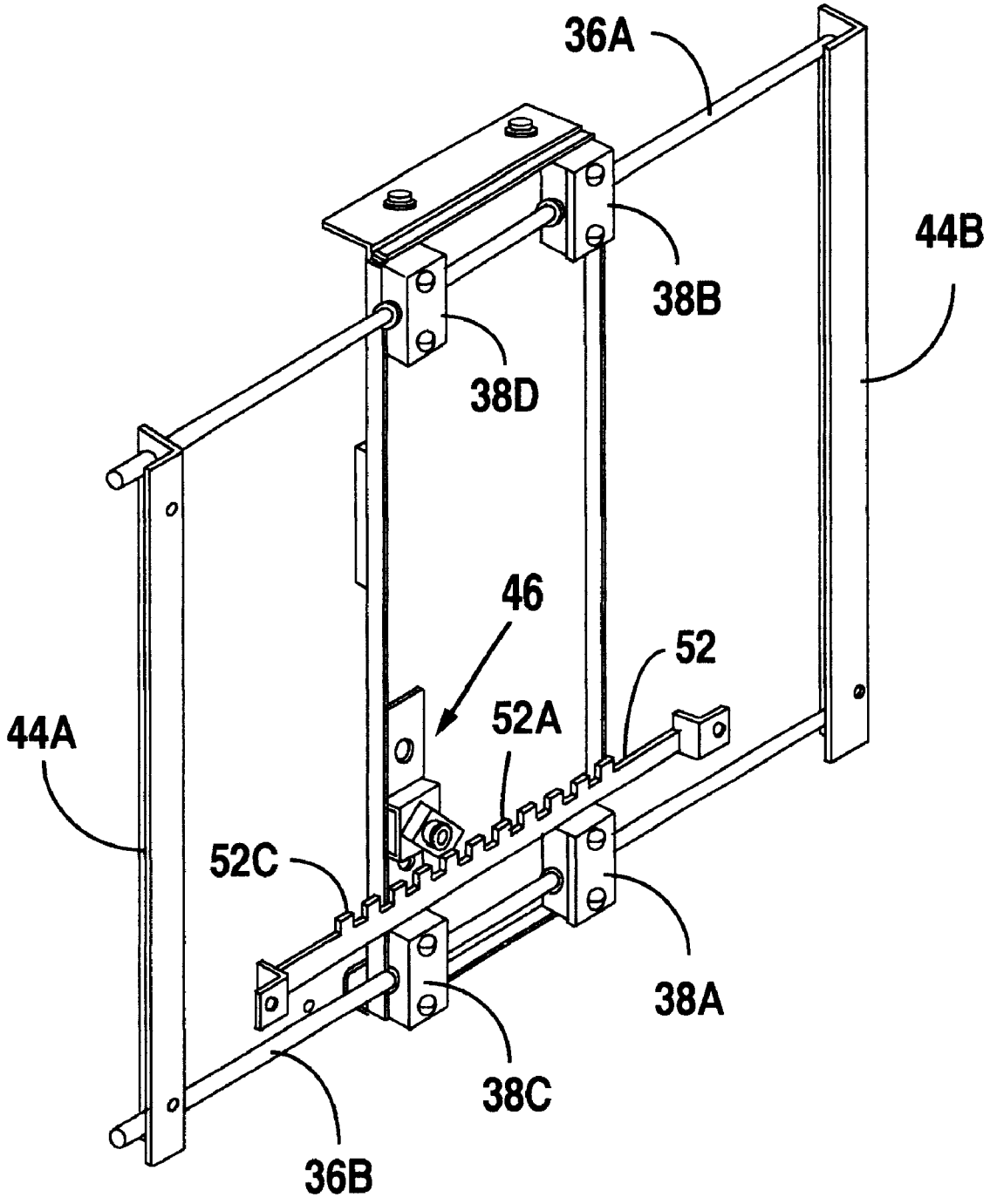
Figure 8:
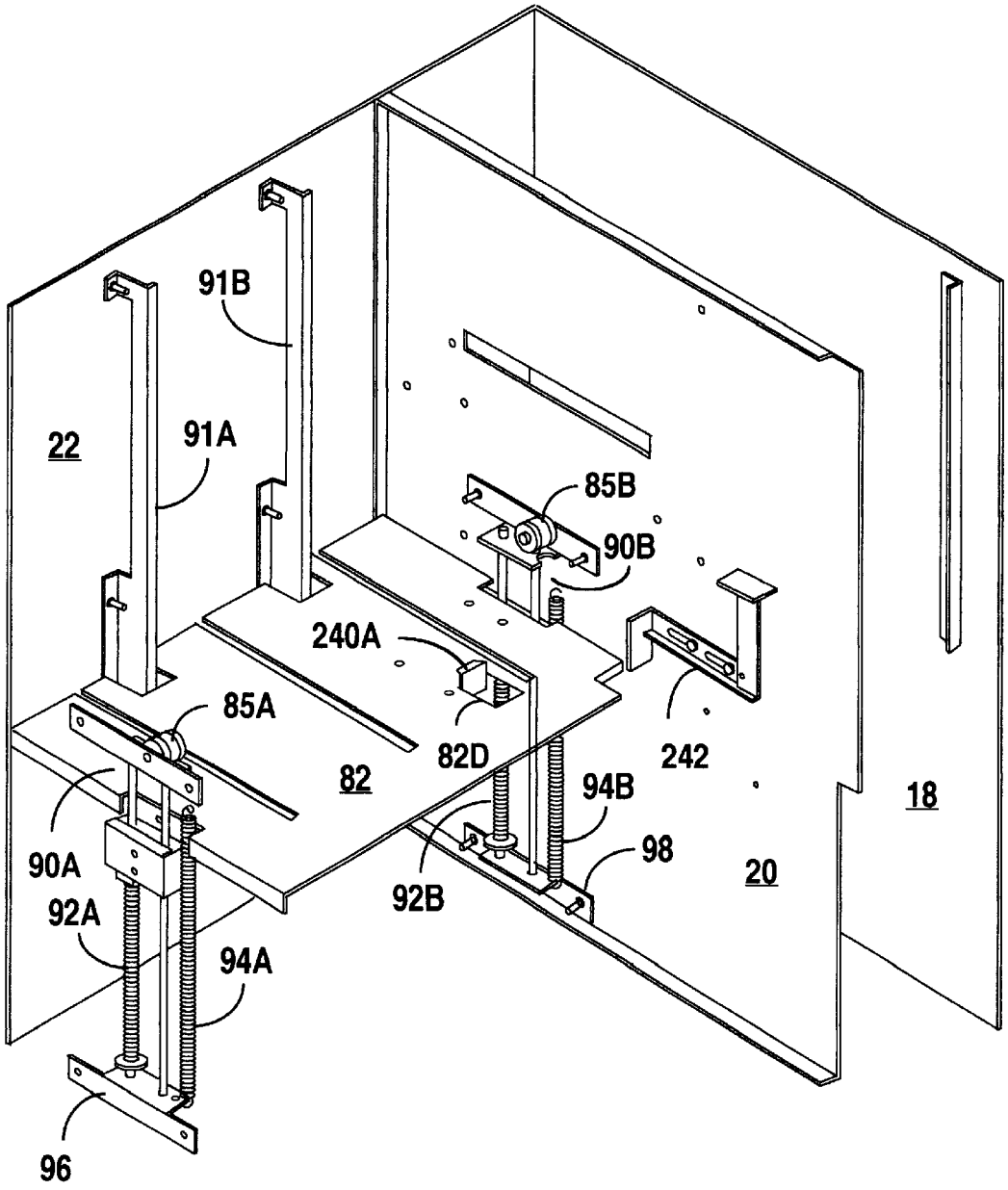
FIG. 8 provides details of the newspaper support platform of Applicant's present invention in perspective view.
Figure 9:
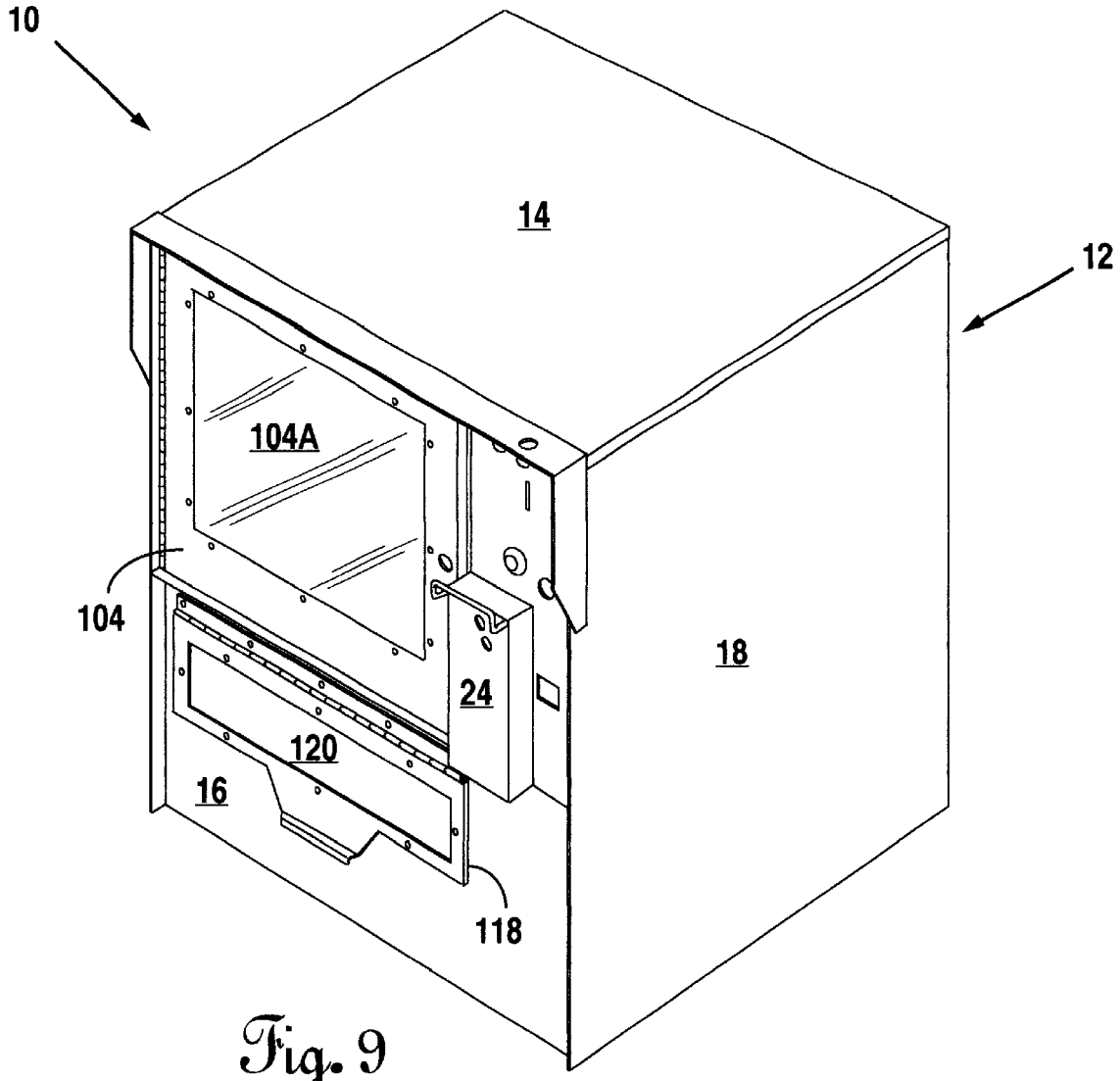
FIG. 9 is an exterior perspective view of Applicant's single vend newspaper dispensing machine.

Turning again to FIGS. 1 and 7, it is seen that scissors assembly (28) is in operative engagement with the scissors assembly adjustable operating arm such that movement of handle (24) between closed and an open position will cause a removed end (28A) of the scissors assembly including prong (28B) to move horizontally. For example, when the handle is pulled out following the insertion of the proper number of coins into coin controlled mechanism (23), scissors assembly adjustable operating arm (30) will move to the left as set forth in FIG. 1. This will cause the scissors assembly to move from a compressed or collapsed position with prong (28B) to the right in slot (20A) to an expanded or extended position with prong (28B) towards the left end of slot (20A). When handle (24) is pushed shut, scissors assembly (28) will move from an expanded to a contracted position. Thus, as it is seen with reference to FIGS. 1 and 6, how sufficient coinage, inserted into the coin controlled latching mechanism will allow the consumer to move the handle and allow the extension then contraction of the scissors assembly of FIG. 1. With this action in mind, reference is now made to FIGS. 2, 3, 7 and 7A.

It is seen that prong (28B) will engage with a drive plate (32). The drive plate is typically a rectangular piece of metal with side walls (32A) and a number of holes (32B) therein for fastening elements (including prong (28B)) to, as set forth in more detail below. The drive plate engages a drive plate guide assembly (34). The function of the drive plate guide assembly is to allow the drive plate to move left and right (or back and forth) as set forth in FIG. 2 under the force provided by the scissors assembly. Optimally, this movement should take a minimum of force. This movement of drive plate (32) is accomplished by providing a pair of circular, horizontally arranged guide bars or rods (36A) and (36B), set forth spaced apart and parallel to one another and attached at the top and bottom of the drive plate with the use of(typically four) bearing assemblies (38A, 38B, 38C and 38D, respectfully). A pair of bearing assemblies (38A and 38C) engage rod (36B) adjacent the lower edge of the drive plate and a pair of bearing assemblies (38B and 38D) attached to rod (36A) near the top edge of the drive plate. Fasteners (41) are seen to mount the bearing blocks to the drive plate. Each of the bearing assemblies includes a bearing block (48A, 48B, 48C and 48D) which bearing blocks contained therein bearings set (typically containing ball bearings) for engaging the two guide bars here. Bearings sets (42A, 42B, 42C and 42D). A pair of vertically aligned guide bar mounting brackets (44A and 44B) attach the drive bars or guides in horizontal, spaced apart relation, parallel to one another adjacent and to inner partition (20) as set forth in FIG. 2. Thus, when the handle is pulled out by the consumer, and the scissors assembly expands and contracts, the drive plate will move to the left and right on ball bearings adjacent to and parallel with inner partition (20).

Engaged with the drive plate and the inner partition is a ratchet assembly (46). The ratchet assembly includes a pivoting pin (48) and a pin mounting plate (50). These two elements are illustrated being mounted to an inner face of the drive plate and adjacent and above a toothed rack (52), the toothed rack (52) being mounted to the inner partition (20). The pin mounting plate is located so that a removed end (48A) of the pivoting pin (48) will engage notches (52A) of the toothed rack. The pivoting pin will lay in the notches such that when the drive plate is moving left to right it cannot back up until it clears the toothed farthest to the end (52C) when the drive plate is moving right to left it cannot reverse motion until it passes the last tooth (52C) on the left end of the rack. Such a rachet assembly will prevent "pumping" of the handle in an attempt by an unscrupulous consumer to vend more than one newspaper.

The next discussion relates to FIG. 2 and elements and assemblies which are attached to the outer face of drive plate (32). It is seen that drive plate (32) is mounted so as to move with "ball bearing" smoothness to left and right adjacent the partition wall as set forth in FIG. 2. Moreover, it is seen with reference to FIG. 2 that a finger platform vertical guide assembly (54) provides a finger platform mounting means (56) with a slider (60), which slider mounts to parallel spaced apart guide bars (64A) and (64B) which in turn are attached to the drive plate through drive bar mounting plates (66) with suitable fasteners (67). Thus, attached to the horizontally moving drive plate is a vertically moving finger platform mounting means, typically a plate as seen in FIG. 2. It is seen with reference to FIG. 2 that finger platform vertical guide (54) includes a hinge plate (58) mounted to the bottom of mounting means (56). The net effect of the vertical guides and the horizontal guides is to provide for movement in two dimensions, up and down and left and right as seen in FIG. 2. However, it is seen that the handle scissors assembly and drive plate guide assembly only control the back and forth or left and right movement of the drive plate.

Figure 3:
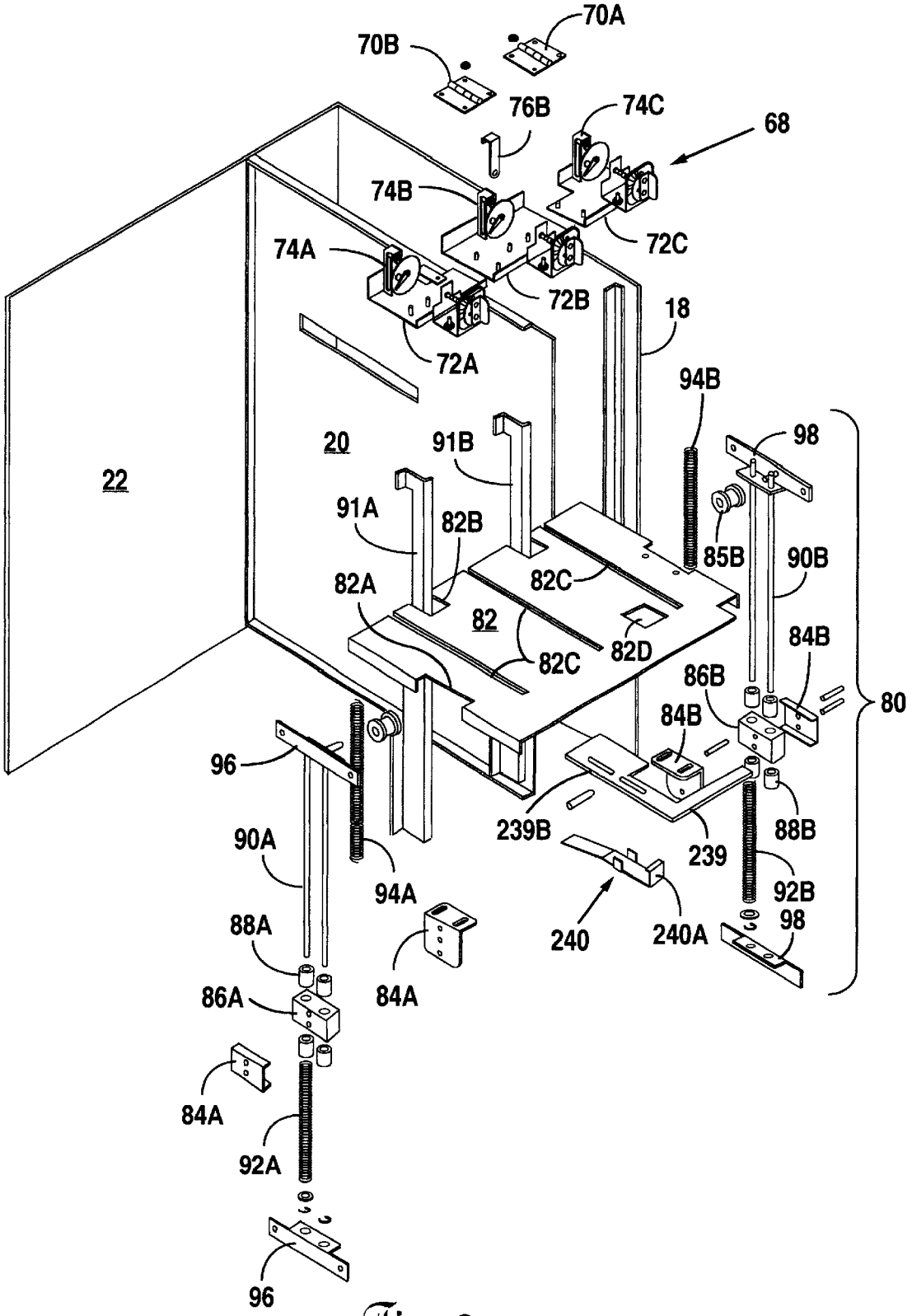
FIG. 3 is a perspective view of the finger platforms and elevated platform of Applicant's present invention.
Figure 10:
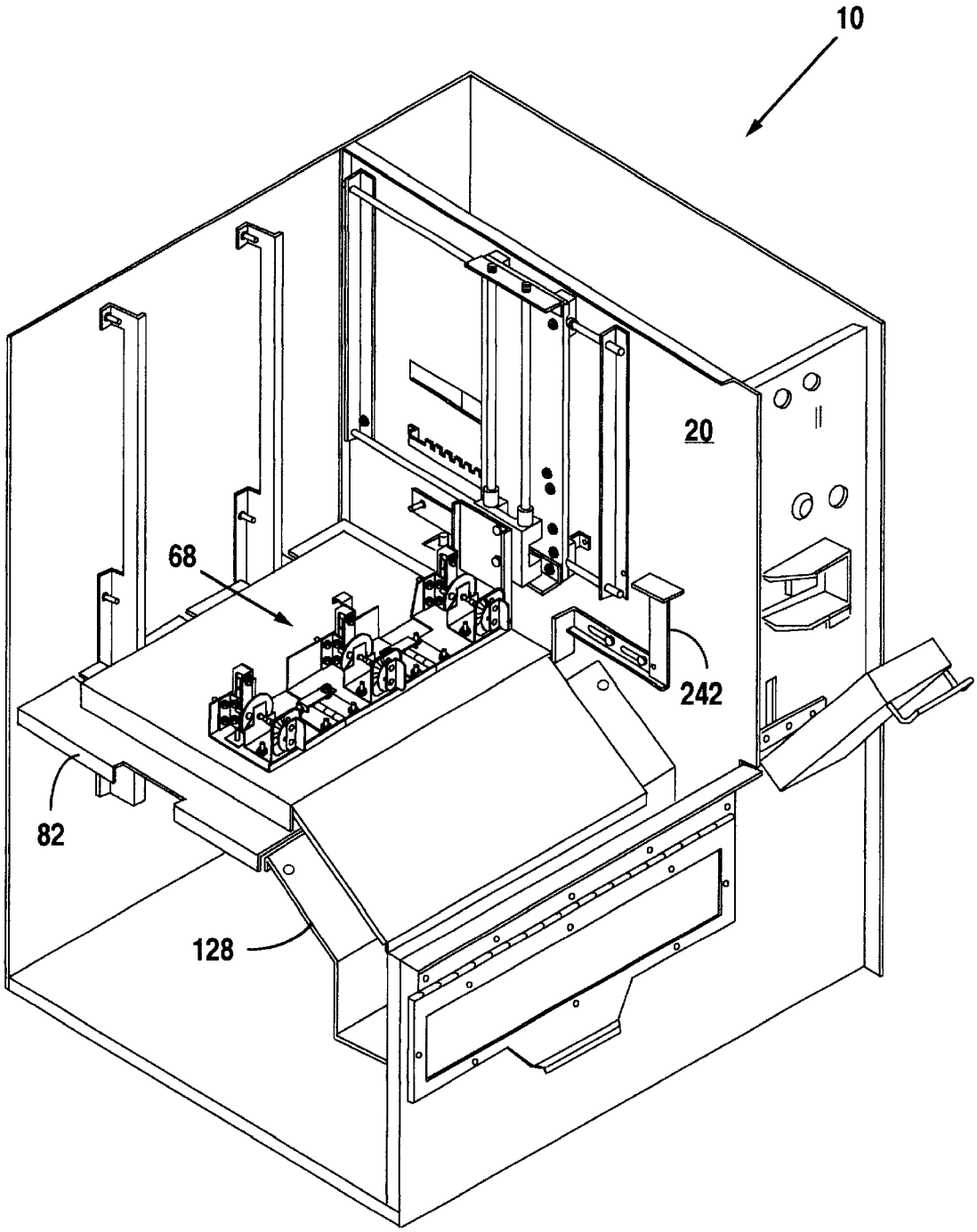
FIG. 10 is an exterior perspective view, partially cut away, of elements of Applicant's single vend newspaper dispensing machine, illustrated in operation.

Turning to FIG. 3 and with reference to finger platform (68), it is seen that hinge plate (58) will pivotally engage the right end of finger platform (68). Finger platform (68) typically aluminum, will lay on the topmost newspaper of a newspaper stack (see FIG. 10). As newspapers are dispensed by the left and right motion of the drive plate, finger platform (68) will fall vertically as slider (60) moves, on ball bearing movement of ball bearing assemblies (62) (typically 4) on guide bars (64A) and (64B).

Thus it is seen that finger platform vertical guide (54) rides on ball bearing assemblies (62) (typically 4) and guide bars (64A) and (64B) (typically 2) to move down as papers are dispensed and to move back up when the route man goes to the cabinet with more newspapers.

Figure 4:
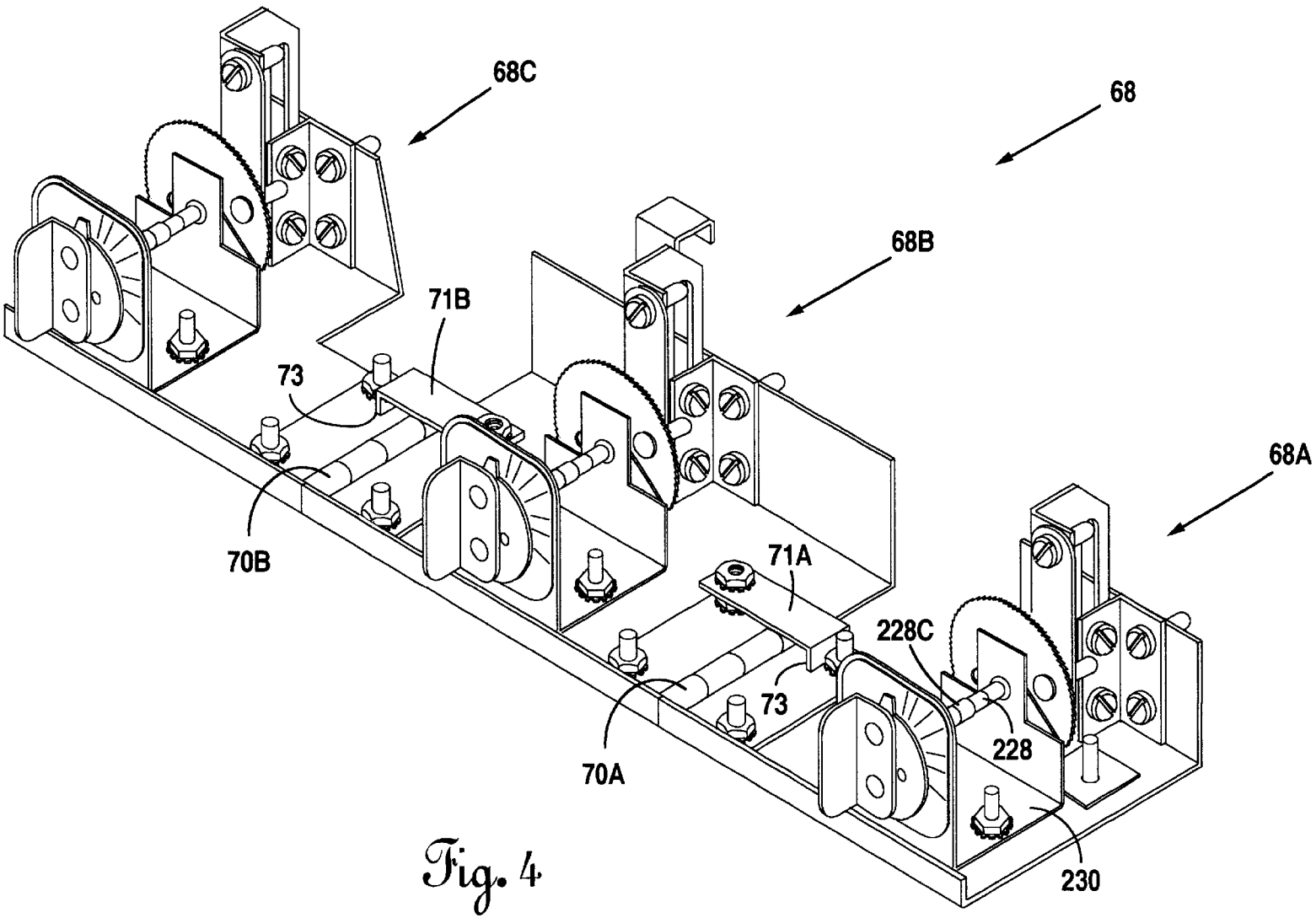
FIG. 4 is a perspective view of the three finger adjustment mechanisms of Applicant's invention.

Turning now to FIG. 4 for an additional illustration of finger platform (68) other details may be appreciated. It is seen with reference to illustration FIG. 4 that finger platform (68) consists of three similarly constructed segments: near end segment (68A), middle segment (68B) and far end segment (68C). Segments (68A and 68B) are connected to one another for the use of hinge (70A) and segments (68B and 68C) are connected to one another for the use of hinge (70B). Thus it is seen that the segments can pivot with respect to one another at the hinge point where they are joined. However, the hinging effect may be controlled using the use of optional hold down clamps (71A and 71B). These clamps fasten to the middle segment and have a lip (73) that protrudes onto the outboard segment for the purpose of limiting the motion of the two outboard segments to a downward pivot. When thick papers (typically 1½–2") are sold, the paper stack, usually at the ends, often tends to bow upward. The clamps tend to stabilize the platform and prevent bowing.

Figure 5:
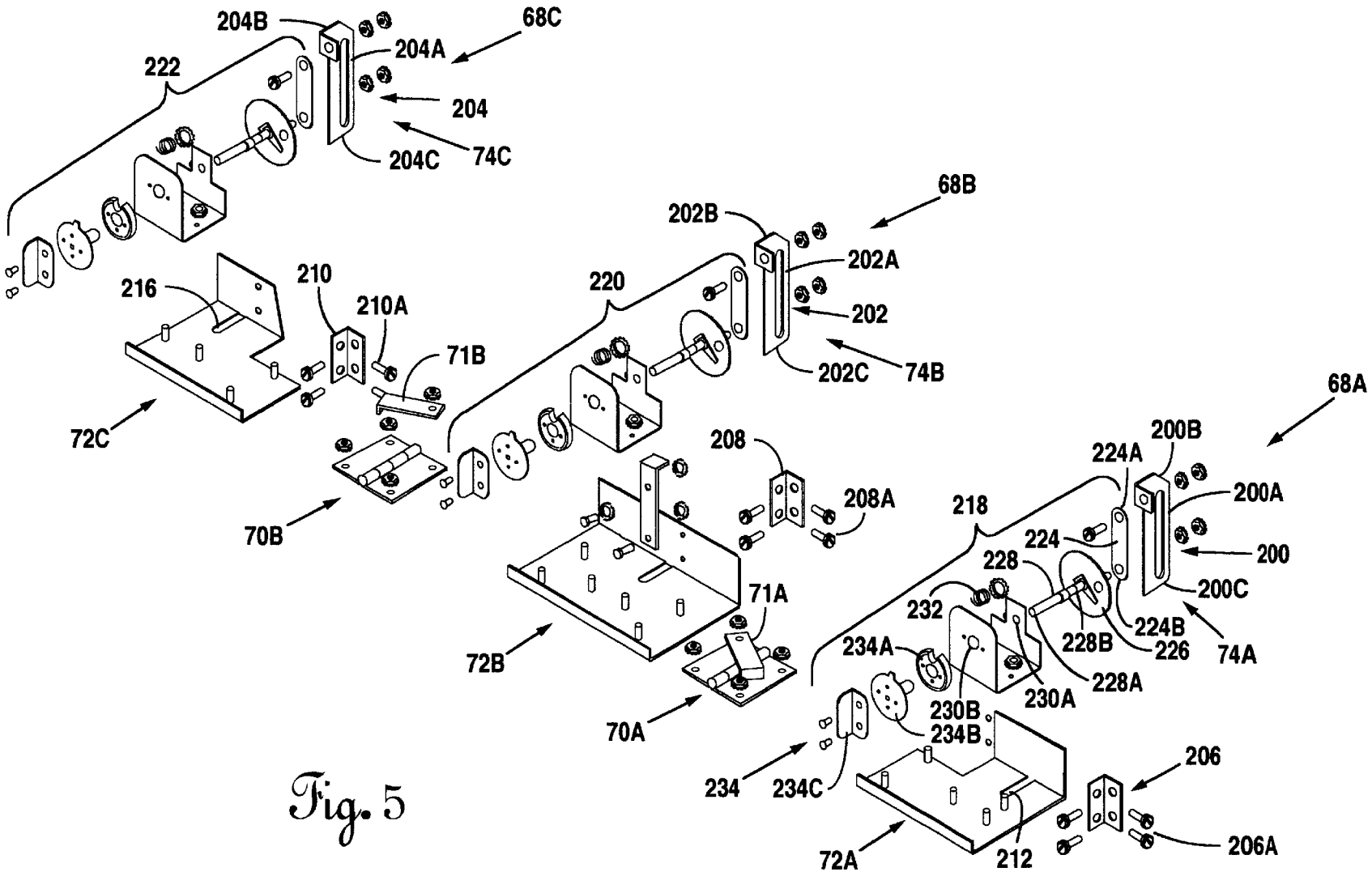
FIG. 5 is the same view as FIG. 4 except exploded.

Reference is made to FIGS. 4 and 5. The three finger adjustment mechanisms (218) (220) (222) each include a finger (200), (202), and (204). Each finger is typically a flat elongated member having a slot (200A), (202A), and (204A) therein. Each finger has a near end (200B), (202B), and (204B), as well as a far or removed end (200C), (202C), and (204C) that is rounded or radiused at a rearward potion thereof. It is seen that guides (206), (208), and (210) attach to plates (72A), (72B), and (72C), respectively, and include guide members (206A), (208A), and (210A) for engagement with slots (200A), (202A), and (204A), respectively. Fingers (200), (202), and (204) are designed to move vertically up and down through plates (72A), (72B), and (72C) at slots (212), (214), and (216) in each of the three plates. Since the three finger adjustment mechanisms are similarly. constructed only one, here (218) in FIG. 5 will be used in the explanation of the parts contained therein and the manner in which they operate. The fingers are engaged at the near end thereof to a drive linkage 224 which has a first end (224A) and a second end (224B). The first end (224A) is attached to the finger and the second end (224B) is attached to a typically circular drive wheel (226) which is mounted to a drive wheel pin (226A). In this manner, rotation of the drive wheel will cause the linkage to move up and down and thus, the fingers to ride up and down as slots move over guide members (206A), (208A), and (210A), respectively.

The drive wheel is mounted to a drive shaft (228), the drive shaft having a near end (228A) and a far end (228B). The drive shaft is mounted to plate (72A) through drive shaft mounting plate (230), having holes (230A), and (230B). With reference to FIG. 4, it is seen how drive shaft (228) mounts to drive shafting mounting plate (230). Turning back FIG. 5, it is seen that spring (232) will ride against shoulder (228C) (see FIG. 4).of drive shaft (228) to urge the drive shaft to the right as seen in FIGS. 4 and 5. It is seen that with reference to FIGS. 4 and 5 that near end (228A) extends through hole (230B) in drive shaft mounting plate (230). The extended portion engages notched mated assembly (234) which includes a first notched member (234A) mounted to the drive shaft mounting plate and a similarly dimensioned second notched member (234B) that is dimensioned to mate with the first notched member, but is attached to the near end of the drive shaft. The second notched member may have a handle (234C) attached thereto. The first and second notched members will engage to maintain the second notched member and the drive shaft drive wheel and linkage in a fixed position, rotationally speaking, since spring (232) is urging the two notched members together. However, the route man may adjust the finger position with respect to the bottom surface of plate (72A) by grasping handle (234C) and pulling it axially slightly against spring (232) to disengage the two notched mating members (234A) and (234B). Following this action, his rotation of the handle in a clockwise direction as seen with respect to FIG. 5 will cause the drive wheel and drive leakage to rotate and move finger (200) downward below or further below the bottom surface of the plate. On the other hand, rotation of second notched member (234B) through the use of handle (234C) in a counter-clockwise direction will raise the finger with respect to the platform. In this manner, the distance that each of the three fingers projects below the surface of the plate may be independently adjusted.

Returning now to FIG. 3, the further details of Applicant's single vend newspaper dispensing machine (10) may be seen. More specifically, it is seen that Applicant's provide a newspaper support platform assembly (80) that includes a flat, typically rectangular platform (82) which is capable of supporting newspapers on the surface thereof and of moving vertically up or down as the newspapers are dispensed. More particularly, it is seen that platform (82) includes side cutouts (82A), rear cutouts (82B), finger slot cutouts (82C), and a trip door opening mechanism (82D). A pair of platform support plates (84A) and (84B) are mounted laterally near the removed edges of the platform, attaching the platform to a pair of bearing blocks (86A) and (86B). The bearing blocks include bearing sets (88A) and (88B) which engage left and right platform guide bar pairs (90A) and (90B) to slidingly support the up and down motion of the platform. A pair of compression springs (92A) and (92B) are dimensioned for receipt on one of each of the two pairs of guide bars and are placed underneath the bearing blocks so as to limit the vertical movement of the platform downward to a point where the effect of the compression springs will be to urge the platform upward such as would be the case when the platform had a full load of newspapers on it. A second set of springs, here tension springs (94A) and (94B), will attach to the respective platform support plates (84A) and (84B) at one end, loop around pulleys (85A) and (85B) and then attached to lower guide bar mounting plates (96) and (98), respectively. The effect of these two springs is to maintain the elevation of the platform (82) when it is loaded with papers. The first spring to come into play to support papers stacked on the platform is the set of tension springs (94A) and (94B). If the weight on the platform is sufficiently great, a second set of springs-here the compression springs located below the bearing blocks-will come into play. This result of having one spring work against the other results in a more sensitive balance on the platform such that the extraction of even a single paper will allow the platform to raise slightly. Thus, as papers are dispensed from the top of the platform through the action of the finger plates moved by action of the scissors mechanism in the handle, the platform will raise slightly. The ball bearing support on the rails further increases the sensitivity of the platform to the release of papers being dispensed. That is, prior art platforms without ball bearing movement or "spring against spring" balance would tend to hang up as they rose in accordance with the dispensing action of papers.

FIG. 3 also illustrates the use of stand off plates (91A) and (91B). The function of these plates is to limit the rearward position of the stack of newspapers on the platform. That is, with the use of the stand off rails (91A) and (91B) the papers can be pushed up against the rails, but will not be pushed so far back that the fingers can not reach the trailing edge of the papers. In other words, Applicant's mechanism requires, for dispensing, that the fingers reach down below the plates beyond the trailing edge of the newspapers so that the dispensing action will allow the fingers to catch the trailing edge of the topmost newspaper and slide it off the paper just below it. To effect such motion, it is required that the fingers be adjusted so as to be able to engage just the topmost paper, and if the papers are wedged right up against the back wall of the cabinet, clearly, the fingers will simply lie atop of the topmost paper.

Turning back now to FIG. 1, it is seen that loading door assembly (102) includes loading door (104). Loading door (104) is attached to the cabinet through hinge (104C). Loading door (104) includes a generally rectangular frame (104B), the frame defining a cutout in which a transparent member, typically plexiglass (104A), is mounted by fastener means. Door (104) typically also includes a lock (104D) at the end opposite the frame to lockingly engage the cabinet and prevent unauthorized access thereof. A door stop arm (104E) is also provided to prevent the accidental over rotation the door.

Attached to the back side of the loading door is a rectangular display box (106) dimensioned to receive a single issue of the newspaper and to hold the single issue of the newspaper so it may be displayed and visible to the consumer through the transparent member. To do this, a back wall of the display box usually has a bias member (112) attached to it which will gently urge the folded newspaper displayed against the inside face of transparent member (104A). Note, that the bottom of the displayed box includes a wall, here drop door ( 108), that pivots so that when one end of it is unlatched the display copy of the paper which it normally supports will fall through the display box. Furthermore, the display box is located over the dispensing opening so that, in a manner set forth in more detail below, when drop door (108) is unlatched, the display copy will be dispensed.

Figure 11A:
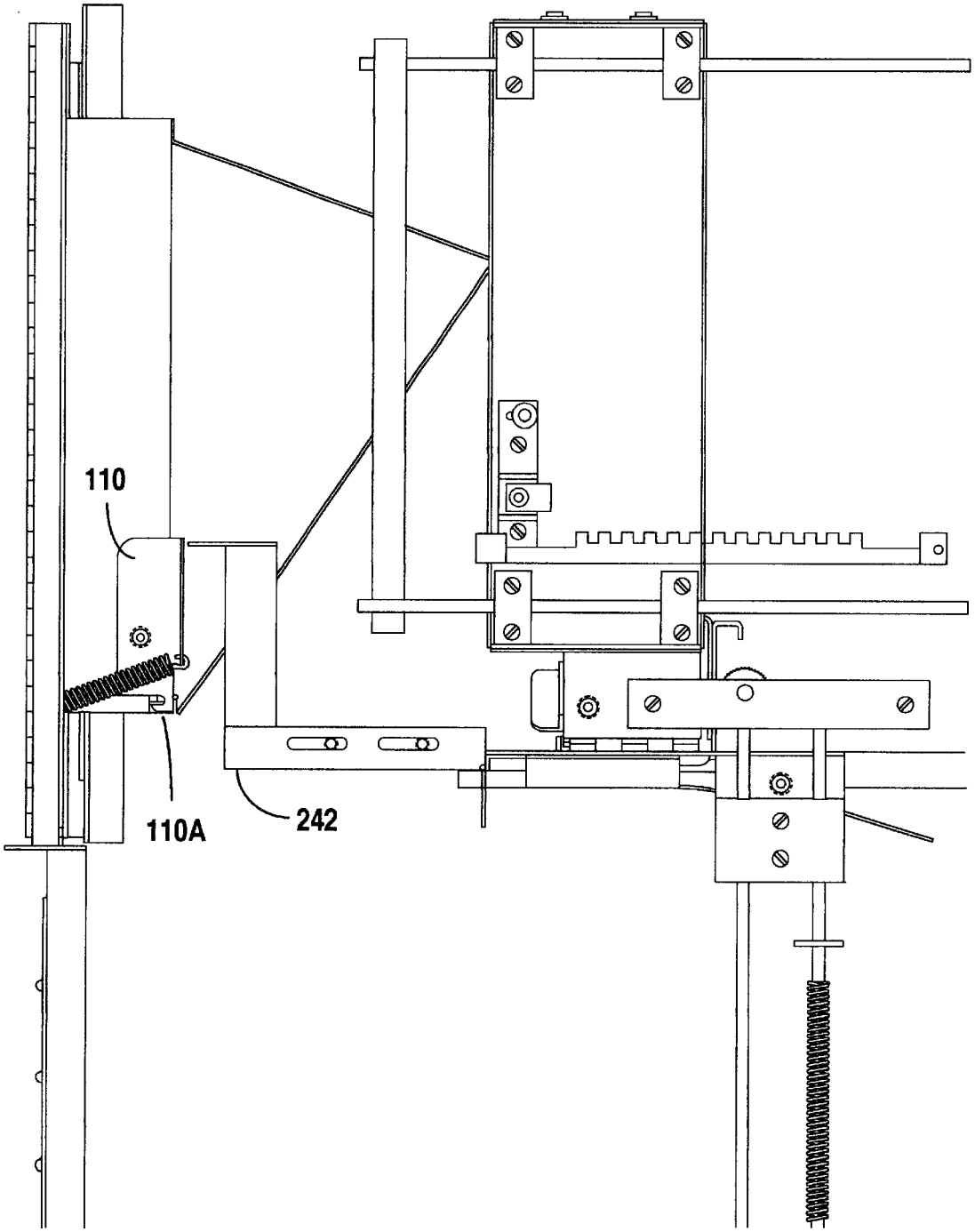
FIGS. 11A and 11B are elevational and perspective views respectively of details of the door mechanisms of Applicant's single vend newspaper dispensing machine.
Figure 11B:
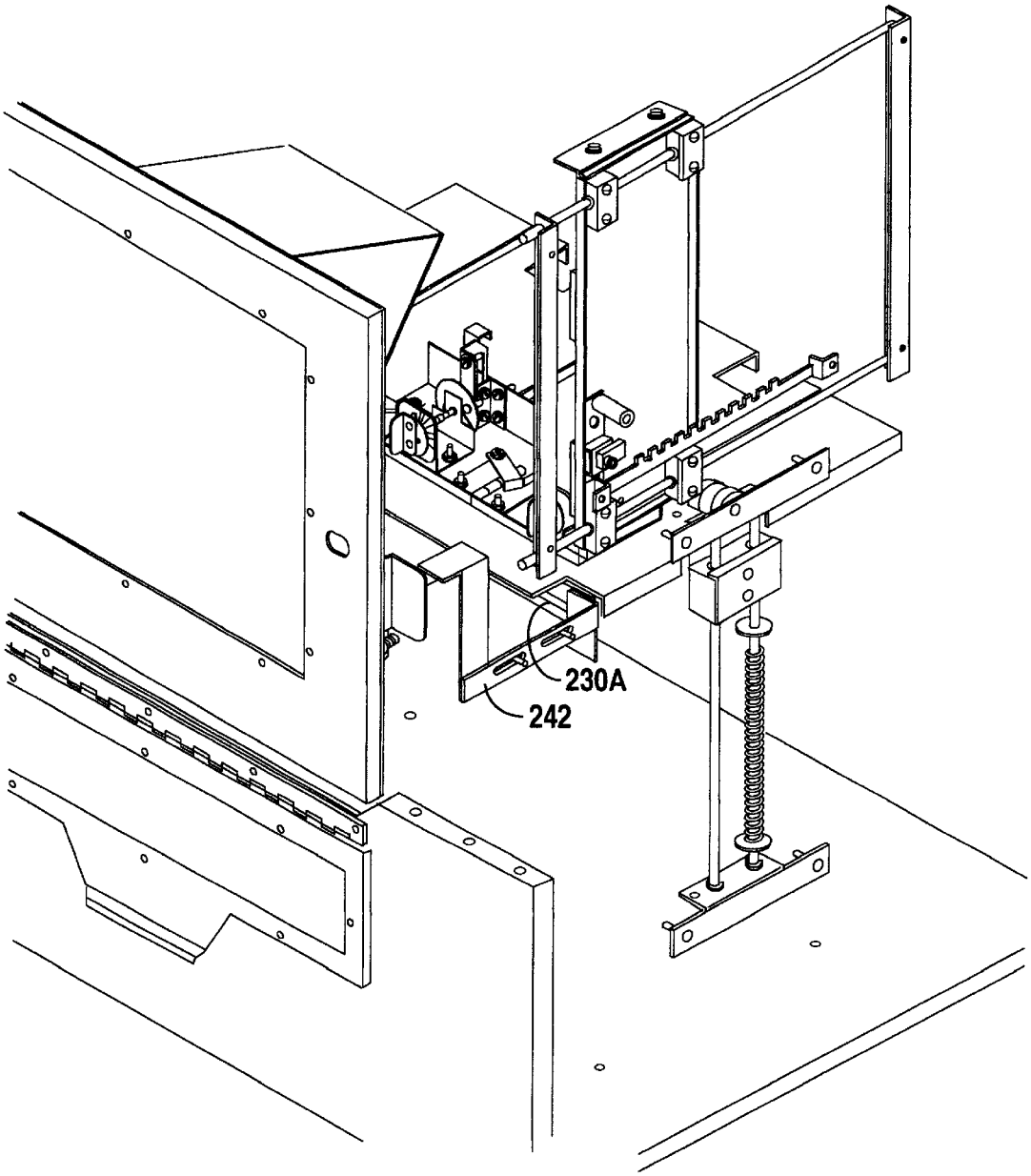

Reference is now made to FIGS. 3, 1A, and 11B. A latch mechanism (110) is provided for engagement of the drop door and for dispensing the display copy of the paper.

FIG. 3 illustrates a slider mechanism (239) which mounts to the underside of the elevated platform (82) through the use of slats (239B). Slider mechanism (239) can slide back and forth on the underside of the platform. Slider mechanism (239) has unbalanced arm (240) attached thereto, which unbalanced arm has vertical member (240A) attached at one end thereof. The sliding mechanism is mounted with the unbalanced arm under the elevated platform such that vertical arm (240A) is positioned in window (82D) of the elevated platform. When the last paper is dispensed, unbalanced arm (240) will allow vertical portions (240A) to project through the window. Therefore, when the carriage is pulled forward, the leading edge of the finger platform will catch the vertical portion (240A) and drag the mechanism 239, forward. At this point, arm (239A) engages the rearward end of interconnect arm (242C), (See FIGS. 11A and 11B). Interconnect arm (242C) is slidably mounted to the inner partition so that arm (239A) strikes one end of (242) and (242) will, in turn, trip latch mechanism (110), which is spring loaded with lip (110A) engaging the trailing edge of drop door (108). This will, in this manner, allow the dispensing copy of the newspaper will fall down so that it is adjacent to the dispensing door and may be accessed by the consumer. Incidently, the back wall 106A of the dispensing box may carry the message "SOLD OUT" or, a similar message to advise the consumer.

Figure 1:
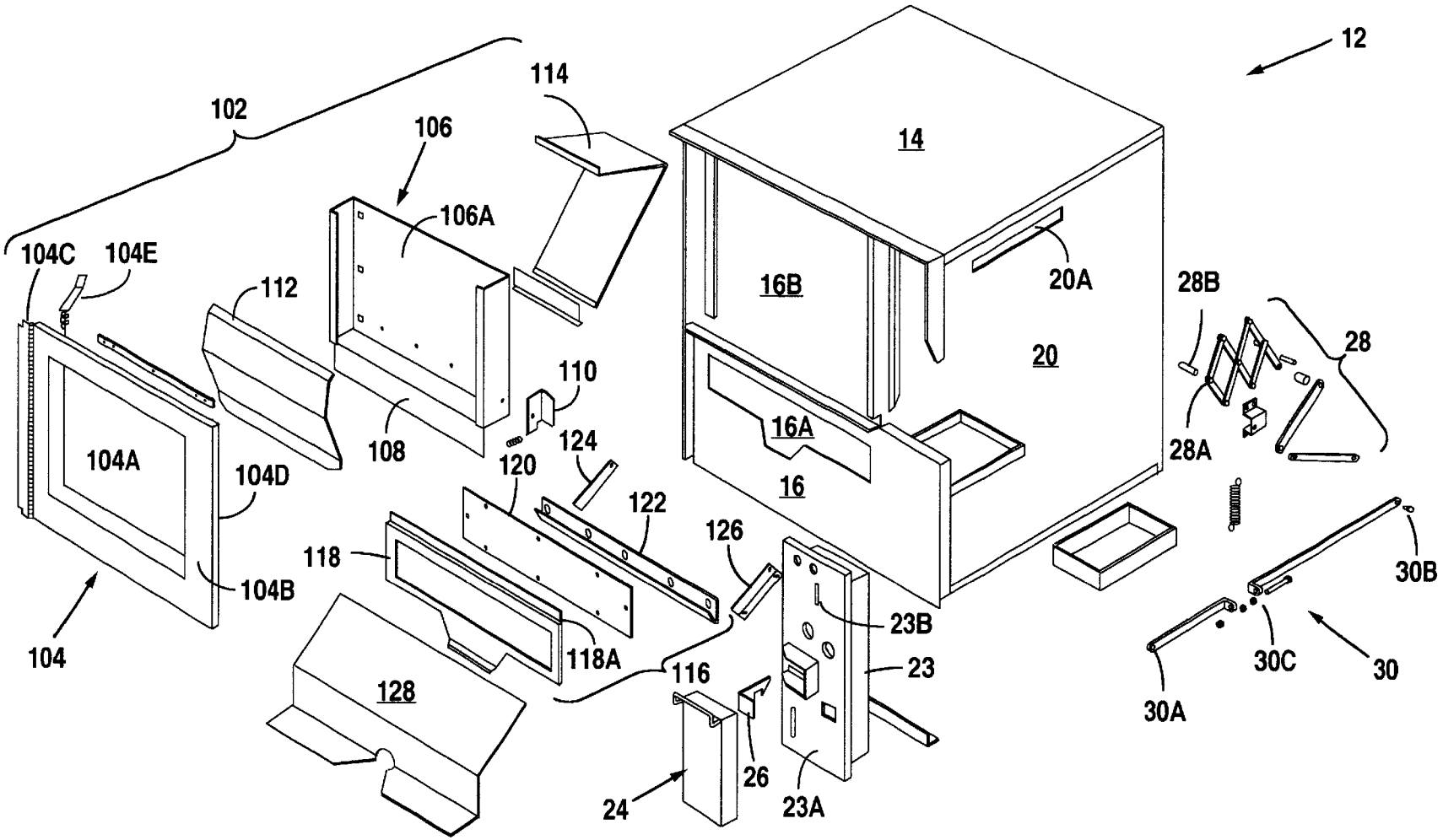
FIG. 1 is an exploded side perspective view with the front right side of the cabinet removed therefrom.

Reference is now made to FIG. 1, attached to the rear surface of the display box is a newspaper guide plate (114). The function of the newspaper guide plate, which may be discerned from its shape, is to engage the stack of papers on platform (82). It engages the papers at such an angle as to both exert a force vector vertically downward on the stack and also a force vector horizontally urging the stack towards the rear of the platform and against stand off plates (91A) and (91B). It is also seen that the use of a newspaper guide plate will assist in deflecting the topmost copy of the paper as it is being dispensed downward towards the dispenser opening.

The dispenser opening includes dispensing door assembly (116). This assembly includes a frame (118), typically rectangular, against which is fastened a transparent member so that the consumer can see through the opening. The frame is seen to include a hinge (118A) for engagement, typically along the top of the frame, to the walls of the cabinet. A dispenser opening platform (128) is affixed to the inner wall of the partition and the left side wall of the cabinet through the use of platform mounting brackets (124) and (126) and is shaped to provide a receptacle in which the newspaper, having fallen under the action of the fingers and gravity, will be guided as it falls and located horizontally toward the front of the cabinet. In other words, the paper dispensed by the action of the fingers will fall and rest against the dispenser opening platform (128) until the consumer opens dispensing door (119) and manually removes the paper. Additional elements of the dispensing door assembly include a front paper guard (122). The front paper guard guides the display copy onto the base platform when it is dispensed.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

We claim:

1. A single vend periodical dispensing machine for dispensing a single newspaper from a multiplicity of periodicals, the single vend periodical dispensing machine comprising:

a cabinet comprising walls including a periodical loading door and a dispensing opening;

a coin controlled latching mechanism;

a dispensing handle for locking engagement with the coin controlled latching mechanism;

a platform for receipt of a multiplicity of stacked periodicals thereon; and a carriage assembly, in operative engagement with said dispensing handle and with the top of the multiplicity of stacked periodicals, for moving the topmost periodical from the stack of periodicals towards the dispensing opening of the cabinet, wherein the carriage assembly includes a multiplicity of fingers for engaging the topmost periodical of the stack of periodicals at a rear fold and, where a customer may grasp and remove the periodical therefrom.

2. The single vend periodical dispensing machine of claim 1 wherein each of the multiplicity of fingers is mounted to a finger platform, with adjacent finger platforms engaged with one another.

3. The single vend periodical dispensing machine of claim 2 further including means to movably adjust the multiplicity of fingers to extend beyond the finger platform to a preselected position.

4. The single vend periodical dispensing machine of claim 3 further including a dial on each of said platforms, the dial indicating the relative extension of the fingers beyond the platform.

5. The single vend periodical dispensing machine of claim 2 further including means to slidably mount at least one finger platform to walls of the cabinet, said means including bearings.

6. A single vend periodical dispensing machine for dispensing a single newspaper from a multiplicity of periodicals, the single vend periodical dispensing machine comprising:

a cabinet comprising walls including a periodical loading door and a dispensing opening;

a coin controlled latching mechanism;

a dispensing handle for locking engagement with the coin controlled latching mechanism;

a platform for receipt of a multiplicity of stacked periodicals thereon;

a carriage assembly, in operative engagement with said dispensing handle and with the top of the multiplicity of stacked periodicals, for moving the topmost periodical from the stack of periodicals towards the dispensing opening of the cabinet, wherein the periodical loading door includes the transparent portion for displaying a display periodical therein, the single vend periodical dispensing machine further including a display periodical support member releasably attached to the loading door such that the release of the display periodical support member will allow the display periodical to fall towards the dispensing opening where a customer may grasp and remove the periodical therefrom.

7. The single vend periodical dispensing machine of claim 6 further including a trip assembly, capable of engagement with the carriage assembly, for releasing the display periodical support member when there are no more periodicals in the stack of periodicals.

8. The single vend periodical dispensing machine of claim 6 further including indicia, viewable from outside the cabinet, after the display paper has been dispensed, said indicia including the words "Sold Out".

9. A single vend periodical dispensing machine for dispensing a single newspaper from a multiplicity of periodicals, the single vend periodical dispensing machine comprising:

a cabinet comprising walls including a periodical loading door and a dispensing opening;

a coin controlled latching mechanism;

a dispensing handle for locking engagement with the coin controlled latching mechanism;

a platform for receipt of a multiplicity of stacked periodicals thereon;

a carriage assembly, in operative engagement with said dispensing handle and with the top of the multiplicity of stacked periodicals, for moving the topmost periodical from the stack of periodicals towards the dispensing opening of the cabinet, further including a first pair of springs urging the platform upwards where a customer may grasp and remove the periodical therefrom.

10. The single vend periodical dispensing machine of claim 9 further including a second pair of springs for engaging the platform.

11. A single vend periodical dispensing machine for dispensing a single newspaper from a multiplicity of periodicals, the single vend periodical dispensing machine comprising:

a cabinet comprising walls including a periodical loading door and a dispensing opening;

a coin controlled latching mechanism;

a dispensing handle for locking engagement with the coin controlled latching mechanism;

a platform for receipt of a multiplicity of stacked periodicals thereon;

a carriage assembly, in operative engagement with said dispensing handle and with the top of the multiplicity of stacked periodicals, for moving the topmost periodical from the stack of periodicals towards the dispensing opening of the cabinet, further including means for preventing the carriage assembly from moving away from the dispensing opening until it has moved a predetermined distance toward the dispensing opening where a customer may grasp and remove the periodical therefrom.

12. A single vend periodical dispensing machine for dispensing a single newspaper from a multiplicity of periodicals, the single vend periodical dispensing machine comprising:

a cabinet comprising walls including a periodical loading door and a dispensing opening;

a coin controlled latching mechanism;

a dispensing handle for locking engagement with the coin controlled latching mechanism;

a platform for receipt of a multiplicity of stacked periodicals thereon;

a carriage assembly, in operative engagement with said dispensing handle and with the top of the multiplicity of stacked periodicals, for moving the topmost periodical from the stack of periodicals towards the dispensing opening of the cabinet, wherein the dispensing opening includes a transparent portion and is located below the periodical loading door where a customer may grasp and remove the periodical therefrom.

13. A single vend periodical dispensing machine for dispensing a single newspaper from a multiplicity of periodicals, the single vend periodical dispensing machine comprising:

a cabinet comprising walls including a periodical loading door and a dispensing opening;

a coin controlled latching mechanism;

a dispensing handle for locking engagement with the coin controlled latching mechanism;

a platform for receipt of a multiplicity of stacked periodicals thereon;

a carriage assembly, in operative engagement with said dispensing handle and with the top of the multiplicity of stacked periodicals, for moving the topmost periodical from the stack of periodicals towards the dispensing opening of the cabinet, further including means to slidably mount said platform to the walls of the cabinet, said means including bearings to ease movement of the platform up and down with respect to the cabinet where a customer may grasp and remove the periodical therefrom.

* * * * *